US005241945A

United States Patent [19]

Shepley, Jr.

[11] Patent Number: 5,241,945

[45] Date of Patent: Sep. 7, 1993

[54] ARCHERY BOW WITH LATERALLY ADJUSTABLE GRIP

[75] Inventor: Paul E. Shepley, Jr., Tucson, Ariz.

[73] Assignee: Precision Shooting Equipment Inc., Tucson, Ariz.

[21] Appl. No.: 818,166

[22] Filed: Jan. 8, 1992

[51] Int. Cl.[5] ..... F41B 5/00

[52] U.S. Cl. ..... 124/88; 124/23.1

[58] Field of Search ..... 124/23.1, 24.1, 20.1, 124/25.6, 86, 88

[56] References Cited

U.S. PATENT DOCUMENTS

| | | | |
|---|---|---|---|
| 3,055,353 | 9/1962 | Perrucci | 124/24.1 |
| 3,176,674 | 4/1965 | Smith | 124/23.1 |
| 3,407,799 | 10/1968 | Reynolds | 124/24 |
| 3,537,439 | 11/1970 | Joslin | 124/24.1 |
| 3,814,074 | 6/1974 | Wood | 124/88 X |
| 4,124,014 | 11/1978 | Darlington | 124/88 |
| 4,175,536 | 11/1979 | Carella | 124/23.1 |
| 4,252,100 | 2/1981 | Rickard | 124/23.1 |
| 4,457,287 | 7/1984 | Babington | 124/23.1 |
| 4,966,124 | 10/1990 | Burling | 124/23.1 |
| 5,081,979 | 1/1992 | Burling | 124/23.1 |

*Primary Examiner*—Randolph A. Reese
*Assistant Examiner*—John Ricci
*Attorney, Agent, or Firm*—Cahill, Sutton & Thomas

[57] ABSTRACT

In an archery bow having a central riser and a separate grip, the grip is made adjustable from side to side by making the width of the channel down the back of the grip greater than the thickness of the riser. Spacers or shims are located between one side of the riser and the grip for adjusting the grip from side to side only. Since the hand of the archer extends around both the grip and the riser, as the grip is moved to the side, the effect is a rotation of the archer's hold on the bow without actually rotating the grip.

14 Claims, 1 Drawing Sheet

ARCHERY BOW WITH LATERALLY ADJUSTABLE GRIP

BACKGROUND

This invention relates to archery bows and, in particular, to a laterally adjustable grip for an archery bow.

Whether hunting or target shooting, an archer strives to develop a consistent form to achieve accuracy with each shot. Various sights, counterweights, and other accessories are available to help the archer achieve this purpose. One item, which is on every bow, that is often overlooked is the grip. A grip is typically a wooden or plastic piece which is curved or shaped to fit the hand of the archer. The grip may be formed as part of the bow itself or be a separate piece. For what is known as a compound bow, the grip is typically a separate piece which straddles the riser, the central portion of a compound bow.

Seen from above, an archer holding a bow at full draw forms a triangle. The arrow is one side of the triangle, extending from the archer's hand (or release mechanism) to the rest, which is attached just above the grip. The archer's arm is the second side of the triangle. The archer's torso forms the third side of the triangle. The angle between the arm of the archer and the arrow depends on the archer's style, the draw length of the bow, and the size of the archer.

A riser typically comprises aluminum or other light metal or alloy and is wider front to back (in the direction of the arrow) than it is from side to side. The grip is aligned with the riser, i.e. with the arrow, not with the archer's arm. The archer thus holds the grip slightly turned in his hand or else bends his wrist backward slightly to hold the grip squarely. A bent wrist is weaker than a straight wrist. Thus, an inconsistency can occur as the archer changes his hold on the bow either through fatigue or lack of concentration or as the archer rotates the bow as the arrow is released.

Adjustable grips are known in the prior art and generally fall into one of two types. The first type is a grip that is adjustable front to rear, in the direction of the arrow. U.S. Pat. No. 4,175,536 discloses a grip of this type. The second type is a grip that is connected to the riser by a ball and socket joint. U.S. Pat. No. 3,407,799 discloses a grip of the second type. While permitting the grip to rotate in several directions, the second type of grip concentrates the draw force in the ball and socket joint and is difficult to position consistently.

In view of the foregoing, it is therefore an object of the invention to provide an improved ergonomic grip for archery bows.

Another object of the invention is to provide a laterally adjustable grip.

A further object of the invention is to provide a grip which couples the draw force over substantially its entire length to the riser.

SUMMARY OF THE INVENTION

The foregoing objects are achieved by the invention in which the grip, whether plastic, wood or other material, has a central channel wider than the riser. Spacers can be placed within the channel between one side of the grip and the riser to provide lateral adjustment. The spacers can comprise any suitable material and preferably comprises one or more small plastic washers. The grip and the spacers are attached to the riser by a pair of screws.

It has been found that, unlike grips using ball and socket joints, it is not necessary for the grip to rotate in order to adjust the grip on a bow to suit the archer. Specifically, it has been found that laterally adjusting the grip provides sufficient adjustment for the archer to consistently hold the bow before, during and after release of the arrow. This not only simplifies construction of the grip but also provides a stronger grip since the grip is firmly attached to the riser at two, spaced apart locations and is supported, on the side, by the spacers and, along the back, by the riser itself.

A more complete understanding of the invention can be obtained by considering the following detailed description in conjunction with the accompanying drawings in which.

DETAILED DESCRIPTION

Figure 1:
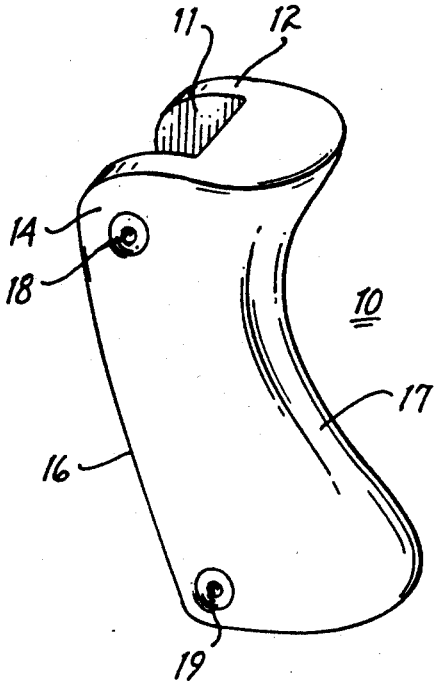
FIG. 1 illustrates a grip constructed in accordance with the invention.

FIG. 1 illustrates a grip in accordance with the invention which can be made from metal, plastic, or wood. Grip 10 has central channel 11 formed in the front surface thereof, running from the top to the bottom of the grip as illustrated in FIG. 1. Channel 11 is defined by side walls 12 and 14 and surface 15. Unlike grips of the prior art, channel 11 is wider than the portion of the riser where grip 10 is attached. This enables grip 10 to move from side to side.

Figure 3:
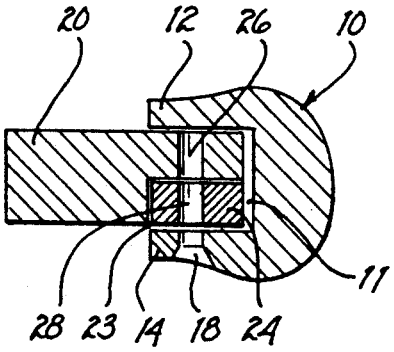
FIG. 3 is a cross-section of the riser of a bow through the section line indicated in FIG. 2.

Front surface 16 is angled to match the angle of the riser, while back surface 17 is contoured to fit comfortably in the palm of the hand. Surface 15 preferably rests on the back of the riser, as shown in FIG. 3. Countersunk bores 18 and 19 provide clearance for a pair of flathead screws (not shown) which attach grip 10 to a riser.

Figure 2:
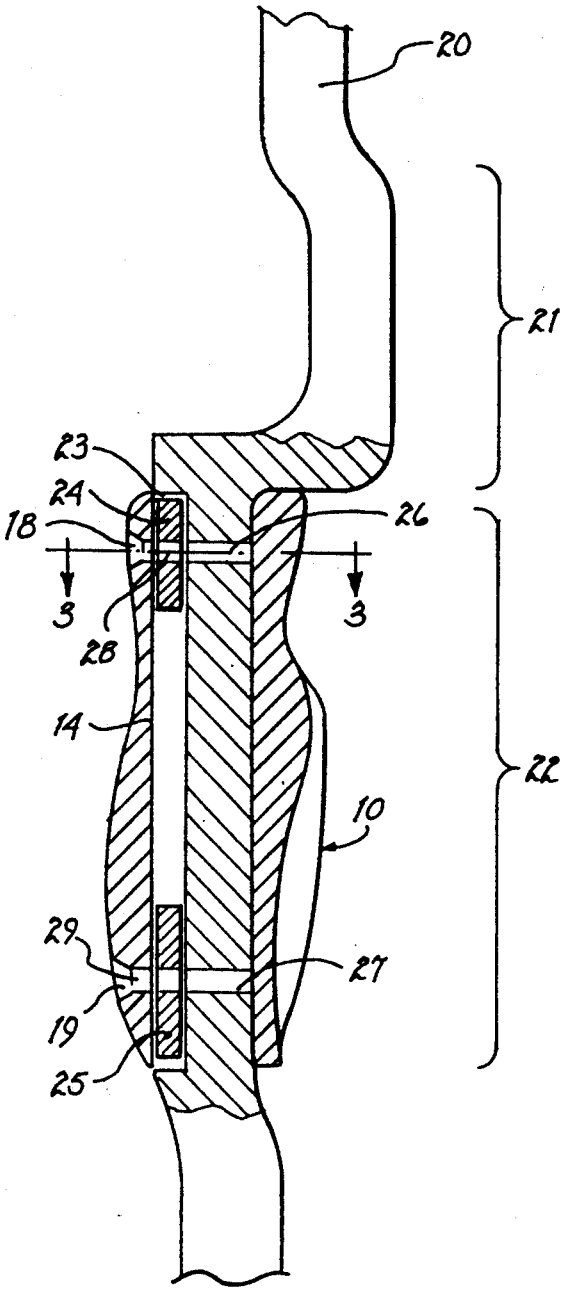
FIG. 2 illustrates in partial cross-section the riser of a bow constructed in accordance with the invention.

FIG. 2 illustrates the central portion of a right-handed compound bow as seen by the archer. Specifically, riser 20 comprises offset portion 21 and handle portion 22. Offset portion 21 provides clearance for the tip and fletching of a hunting arrow, or the fletching of a target arrow, and can have any one of a variety of arrow rests attached thereto for locating the arrow above grip 10.

Handle portion 22 has a reduced thickness section or recess 23 formed in the left-hand side thereof. Grip 10 straddles handle portion 22 and sidewall 14 is shaped to fit within recess 23. Located between sidewall 14 and handle portion 22 are washers 24 and 25. Handle portion 22 has bores 26 and 27 formed therein in alignment with bores 18 and 19 in grip 10. Similarly, washers 24 and 25 contain bores 28 and 29, respectively, which align with bores 18 and 19 in grip 10. Bores 26 and 27 are threaded. Flathead screws (not shown) pass through the bores in the grip and the washers and engage bores 26 and 27 to fasten grip 10 and the washers to riser 20.

The depth of recess 23 is not critical. A depth of 0.25 inches (6 mm) has been found effective. As illustrated in FIG. 2, washers 24 and 25 have approximately the same thickness as the depth of recess 23, which locates grip 10 in its left-most position. Thinner washers locate grip 10 further to the right and the absence of washers locates grip 10 at its right-most position. While a single washer is illustrated at each screw location, several thinner washers can be used at each screw location instead.

FIG. 3 illustrates a cross-section in a horizontal plane through section line 3—3 of FIG. 2. Grip 10 straddles riser 20 with sidewalls 12 and 14 of channel 11. Located between sidewall 14 and riser 20 is washer 24 fitting within recess 23. The components are shown more loosely spaced in FIG. 3 than they are in practice. Surface 15, for example, preferably rests against riser 20 along the length of grip 10 to stabilize the grip.

The hand of the archer extends around both the grip and the riser so that, as the grip is moved to the left, the effect is a rotation of the archer's hold on the bow without actually rotating the grip. Thus, one obtains a more consistent hold on the bow without weakening the structure of the bow by having a rotating grip.

Having thus described the invention, it will be apparent to those of skill in the art that various modifications can be made within the scope of the invention. For example, the recess is preferably formed in only one side of the riser to reduce the time and cost of machining the riser. One can form the recess on either or both sides of the riser. For thinner risers, or thicker grips, the recess can be omitted. While it is preferred that the spacers comprise washers, the spacers can comprise one or more thin sheets fitting within the recess to achieve lateral adjustment of the grip. Although described in conjunction with a riser for a compound bow, the invention can be applied to all bows. The use of washers or thin sheets provides a sturdy, yet relatively inexpensive adjustment. However, the adjustment is incremental, not continuous. At somewhat greater expense, a continuous adjustment can be obtained by using a pair of tapered washers at each screw location or by using an adjustment screw connected to the grip.

I claim:

1. An archery bow having a laterally adjustable grip, the bow comprising:

a handle portion having a width from front to back greater than the thickness from side to side;

a grip having a channel extending the length thereof on the front of said grip for receiving said handle portion therein and having a contoured shape on the back of said grip, wherein said channel has sides and a bottom and the width of said channel is greater than said thickness;

one or more removable spacers interposed between at least one side of said channel and said handle portion, wherein the number of spacers on either side of said handle portion determines the lateral positioning of said grip; and fastening means for attaching said one side and said spacers to said handle portion.

2. The archery bow as set forth in claim 1 wherein said handle portion includes a recess for receiving said grip, said recess reducing the thickness of said handle portion.

3. The archery bow as set forth in claim 2 wherein said spacers are located in said recess.

4. The archery bow as set forth in claim 3 wherein said spacers comprise washers.

5. The archery bow as set forth in claim 3 wherein said spacers comprise a plurality of washers aligned with said fastening means.

6. The archery bow as set forth in claim 1 wherein said grip, said spacers, and said handle portion each include at least one bore for receiving said fastening means.

7. The archery bow as set forth in claim 6 wherein the bore in said grip is countersunk and said fastening means comprises a screw.

8. The archery bow as set forth in claim 6 wherein said spacers comprise at least one washer aligned with the bore in said grip.

9. The archery bow as set forth in claim 1 wherein the bottom of said channel rests on the back of said handle portion.

10. In an archery bow having a riser including a handle portion and a grip straddling the back of said handle portion, the improvement comprising:

said handle portion including a recess in one side thereof for receiving said grip;

said grip having a channel whose width is greater than the thickness of said handle portion at the location of said recess;

said grip straddling said handle portion at the location of said recess and resting on the back of said handle portion, thereby permitting said grip to be laterally adjustable; and one or more removable spacers fitting within said channel on either side of said handle portion for locating said grip from side to side with respect to said riser.

11. The archery bow as set forth in claim 10 wherein said spacers comprise washers.

12. The archery bow as set forth in claim 11 wherein said grip comprises a pair of bores and further comprising a pair of screws fitting within said bores for attaching said grip to said handle portion.

13. The archery bow as set forth in claim 12 wherein said washers are aligned with said bores so that said screws pass through said washers.

14. The archery bow as set forth in claim 10 wherein the bottom of said channel rests on the back of said handle portion.

* * * * *